US008294743B2

(12) United States Patent
Hillis et al.

(10) Patent No.: US 8,294,743 B2
(45) Date of Patent: Oct. 23, 2012

(54) THERMAL MARKING SYSTEM

(75) Inventors: W. Daniel Hillis, Encino, CA (US); Randall Adam Yates, Ventura, CA (US)

(73) Assignee: Applied Minds, LLC, Glendale, CA (US)

( * ) Notice: Subject to any disclaimer, the term of this patent is extended or adjusted under 35 U.S.C. 154(b) by 0 days.

(21) Appl. No.: 13/288,871

(22) Filed: Nov. 3, 2011

(65) Prior Publication Data

US 2012/0046166 A1 Feb. 23, 2012

Related U.S. Application Data

(62) Division of application No. 12/340,361, filed on Dec. 19, 2008, now Pat. No. 8,085,285.

(60) Provisional application No. 61/015,158, filed on Dec. 19, 2007.

(51) Int. Cl.
*B41J 2/315* (2006.01)
*B41J 3/32* (2006.01)

(52) U.S. Cl. ..... 347/171

(58) Field of Classification Search ..... 347/171; 283/5, 89, 92; 434/306; 232/2, 51, 57
See application file for complete search history.

(56) References Cited

U.S. PATENT DOCUMENTS

| | | | | |
|---|---|---|---|---|
| 4,080,532 | A | 3/1978 | Hopper | |
| 4,213,135 | A * | 7/1980 | Medvecky | 347/197 |
| 4,238,179 | A | 12/1980 | Llabres et al. | |
| 5,337,393 | A | 8/1994 | Reunamaki | |
| 5,407,891 | A | 4/1995 | Matsushita et al. | |
| 6,562,755 | B1 * | 5/2003 | Halbrook et al. | 503/201 |
| 6,938,541 | B2 | 9/2005 | Vomberg | |
| 6,972,780 | B2 * | 12/2005 | Bjorkman et al. | 347/171 |
| 7,312,176 | B2 | 12/2007 | Hamada et al. | |
| 7,947,404 | B2 | 5/2011 | Andreas-Schott et al. | |
| 2008/0156855 | A1 | 7/2008 | Sanchez | |
| 2009/0322070 | A1 * | 12/2009 | Reichelsheimer et al. | 283/5 |

FOREIGN PATENT DOCUMENTS

JP 2008-308555 12/2008

* cited by examiner

*Primary Examiner* — Charlie Peng
(74) *Attorney, Agent, or Firm* — Michael A. Glenn; Glenn Patent Group

(57) ABSTRACT

One or more arrays of heating elements are configured with insulating regions to prevent the dissipation of heat to unintended regions of a thermochromic substrate. Methods include printing and arranging impressions on a two-sided substrate avoiding bleeding and other problems more-commonly associated with traditional two-sided thermal printing techniques. A simple and reliable thermal printing system is provided for use in ballot marking, including several mechanisms for receiving and detecting the orientation of a substrate within a thermal printing apparatus.

9 Claims, 13 Drawing Sheets

THERMAL MARKING SYSTEM

CROSS REFERENCE TO RELATED APPLICATIONS

This patent application is a divisional of U.S. patent application Ser. No. 12/340,361, filed Dec. 19, 2008, now U.S. Pat. No. 8,085,285, which is currently allowed and which claims priority from U.S. provisional patent application No. 61/015,158, filed Dec. 19, 2007, each of which are hereby incorporated in their entirety by this reference thereto.

BACKGROUND OF THE INVENTION

1. Technical Field

The invention relates to the field of thermal printing. More specifically, the invention relates to thermal printing techniques for producing markings on multiple sides of a thermochromic medium. Particular embodiments of the invention are particularly useful in thermal printing applications to mark votes on a two-sided ballot during an election to provide visual evidence of voters' selections.

2. Description of the Related Art

In general, thermal printing methods produce an image by selectively heating a thermochromic medium using a thermal printer head. Thermal printing is typically practiced by first applying a coating of thermochromic dye to a substrate, resulting in a thermochromic medium. Thermochromic dye is responsive to heat and changes its appearance when heat-activated, resulting in a marking. After an application of dye, the process continues by selectively applying heat to various regions of the thermochromic medium, thus leaving markings on the medium. However, various problems exist in the field of thermal printing. For example, as heat naturally dissipates, bleeding may occur, thus marking unintended regions of the medium. In particular, a marking on one side of the printing medium may conduct through the substrate, resulting in an unintended marking on the opposite side.

Recent controversies surrounding the accuracy of electoral systems have led to the development of direct recording electronic (DRE) voting machines that, according to proponents, minimize the number of inadvertently spoilt ballots. Critics of DRE machines, however, challenge the resulting lack of a voter verifiable paper trail. Consequently, hybrid systems have been proposed in which an electronic voting machine, e.g. a computer with a touch sensitive display, assists voters in marking a paper ballot that may be inspected by the voter prior to optical scanning. In these systems the ballots are archived should the counting procedure be subsequently contested.

Thermal printing is an attractive technology for use in ballot marking systems on account of the simple and reliable printing mechanism and the relatively low resolution of typical ballot markings. However, as explained above, an unintended marking of a ballot due to the shortcomings of the current state of the art negates the advantages of employing a thermal printing system to record votes.

Furthermore, the majority of existing thermal printing systems are capable of printing only on a single side of each sheet of thermochromic media. Typically, a thermochromic coating is applied to only one side of the substrate. However, when marking printable media, a desire for readability and simplicity strongly motivates printing on both sides of a single sheet of thermochromic media. In the case of a ballot, limiting a printable media to a single sheet simplifies ballot handling and improves the integrity of the election by eliminating the possibility of a split ballot. Yet the length of many ballots, especially those with multiple voter initiatives, makes compressing all election issues onto a single side of a single sheet a difficult endeavor if readability is to not be compromised. The increased surface area available to two-sided printing systems strongly motivates the use of a printing system with two-side printing capability.

Various two sided thermal printing systems have been proposed, but typically either increase the complexity of the heating element control system or require a substrate of sufficient thickness and insulating capability as to prevent heat conduction from one side to the other. However, simpler approaches would be highly desirable for use in ballot marking.

Of course, any thermal printing system must ensure uniform thermal contact between the thermochromic ballot and the heating elements that produce the markings. Indeed, ensuring proper contact in the case of marking ballots presents special challenges. This is because the ballots are necessarily handled by voters themselves, who may or may not be familiar with thermal printing technology. Thus, there is a need for a simple yet reliable mechanism for ensuring uniform contact between the ballot and the heating elements after the ballot is received from the voter.

SUMMARY OF THE INVENTION

In some embodiments of the invention, a fixed size and layout of a printable medium allows the use of a fixed array of heating elements that remain stationary relative to the printing medium during printing, greatly simplifying the printing procedure.

In some embodiments of the invention, a system and apparatus are disclosed comprising one or more arrays of heating elements configured with alternating heating regions and insulating regions to selectively heat regions on a substrate treated with a thermochromic coating.

In some embodiments, two or more arrays of heating elements are disposed facing towards each other and are configured with a slot to accept a two-sided medium formed with thermochromic coatings on each side of a substrate. According to these embodiments, techniques are disclosed for printing on a two-sided medium, as well as techniques for designing a two-sided medium to mitigate the adverse effects typically associated with the conduction of heat away from the applied location and through the substrate, as well as other problems more-commonly associated with traditional two-sided thermal printing techniques.

In some embodiments, the two-sided medium is a voting ballot. Similarly, some embodiments of the invention provide simple and reliable thermal printing systems for use in ballot marking. The ballot markings are produced by a heating element array (HEA) in thermal contact with the ballot.

The invention also provides an apparatus for receiving and orienting a thermochromic medium. Likewise, methods of receiving and orientating a voting ballot are also disclosed that, while simple for the voter to operate, ensure reliable thermal contact between the ballot and the HEA. In particular, the receiving and orienting mechanisms are capable of accepting either folded or unfolded ballots in any orientation, greatly reducing the opportunities for voter error. In some embodiments, orientation indicators and/or sensors are employed to automatically tell a processor about the orientation of a ballot inserted into the voting machine.

DETAILED DESCRIPTION OF THE INVENTION

Some embodiments of the invention comprise an apparatus with one or more arrays of heating elements configured with heating regions and insulating regions to selectively heat selected areas of a substrate treated with a thermochromic coating.

Heating Element Arrays

Figure 1A:
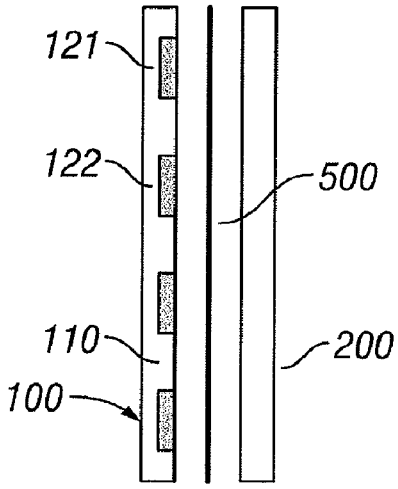
FIG. 1A is a schematic side view of a heating element array (HEA) for marking a thermochromic medium according to some embodiments of the invention.

FIG. 1A shows a heating element array (HEA) for marking a thermochromic medium according to the invention. In the presently preferred embodiment of the invention, the thermochromic medium is a ballot 500. However, it will be readily apparent to those having ordinary skill in the art having the benefit of this disclosure that the invention may be used to mark a wide array of thermochromic media to yield a correspondingly wide array of printed materials.

The ballot 500 is positioned between the HEA 100 and an insulator 200. In this and the following figures, the ballot 500, HEA, and insulator 200 are shown with a small separation for clarity. In actual use, these components are preferably in direct thermal contact with one another.

According to presently preferred embodiments of the invention, the heating elements 121 and 122 within the HEA are surrounded by an insulating substrate 110. The heating elements can be heated individually to mark the ballot 500 as desired. The insulating substrate 110 and insulator 200 help contain the applied heat to the immediate vicinity of the heating element such that the mark produced by an individual heating element 121 or 122 is limited to the dimensions of the heating element 121 or 122, respectively. As such, it is easy to design a ballot or other thermochromically printed materials.

In some embodiments of the invention, the HEA is constructed using a printed circuit board (PCB). The heating elements may be either surface mount resistors or shaped traces. While shaped traces allow for more precise control of the shape of the marking produced on the ballot, surface mount resistors provide sufficient resolution for many applications. Notably, the commonly available "0201" surface mount package is capable of producing a marking as small as 0.002 in by 0.001 in.

Figure 1B:
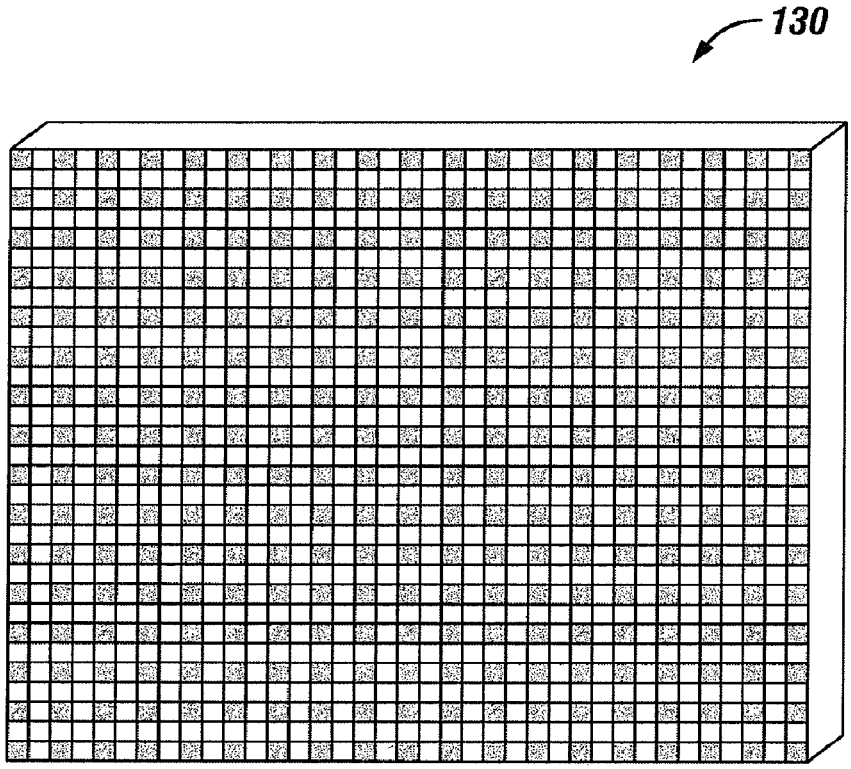
FIG. 1B is a schematic isometric view of a single plate of a heating element array according to some embodiments of the invention.

Since the ballot 500 can only be marked when positioned near the heating element 121, and 122, the heating elements 121, and 122 are preferably arrayed in a regular pattern and substantially cover the entire extent of the ballot 500. FIG. 1B is an isometric view of a plate incorporating a heating element array 130 containing a matrix of heating elements, indicated by filled boxes, separated by rows and columns of insulating substrate, indicated by empty boxes. Using a matrix of heating elements, like the matrix illustrated in FIG. 1B, allows the HEA to be used for many different printing layouts, and greatly simplifies the ballot design processes.

A heating element array using a matrix pattern of heating elements is particularly useful in printing applications in which the medium to be printed upon comprises a plurality of check boxes or the like. According to some embodiments of the invention, a method of designing a check box medium is provided to specifically match the design of the heating element array. Check box type applications typically associate the check boxes with some other text. For example, a voting ballot typically includes a list of candidates written in text with an associated checkbox logically placed proximate to the text to indicate one's vote for that candidate. The invention provides solutions for designing a check box medium to be used for ballot markings in two-sided thermal printing environment.

In the presently preferred embodiment of the invention, a ballot is designed for a thermal printing system such that voting choices are memorialized. According to some embodiments, a ballot is designed for a thermal printing voting machine, wherein the ballot and printer are configured such that the machine accurately marks the ballot irrespective of the orientation of the ballot within the machine. To accomplish this aspect of the invention, one or more ballot orientation indicators and one or more corresponding sensors are utilized as explained below.

Two-Sided Thermal Printing

The invention provides techniques for manufacturing a thermochromic medium by treating a substrate with a thermochromic coating on both sides and applying heat to on one side of the medium such that the heat will not produce a visible marking on the other side of the medium. The manufacturing techniques provide this functionality despite assuming that heat applied to one side of the medium will conduct through the substrate with a sufficient intensity to activate a thermochromic coating applied to the opposite side of the substrate.

Figure 2A:
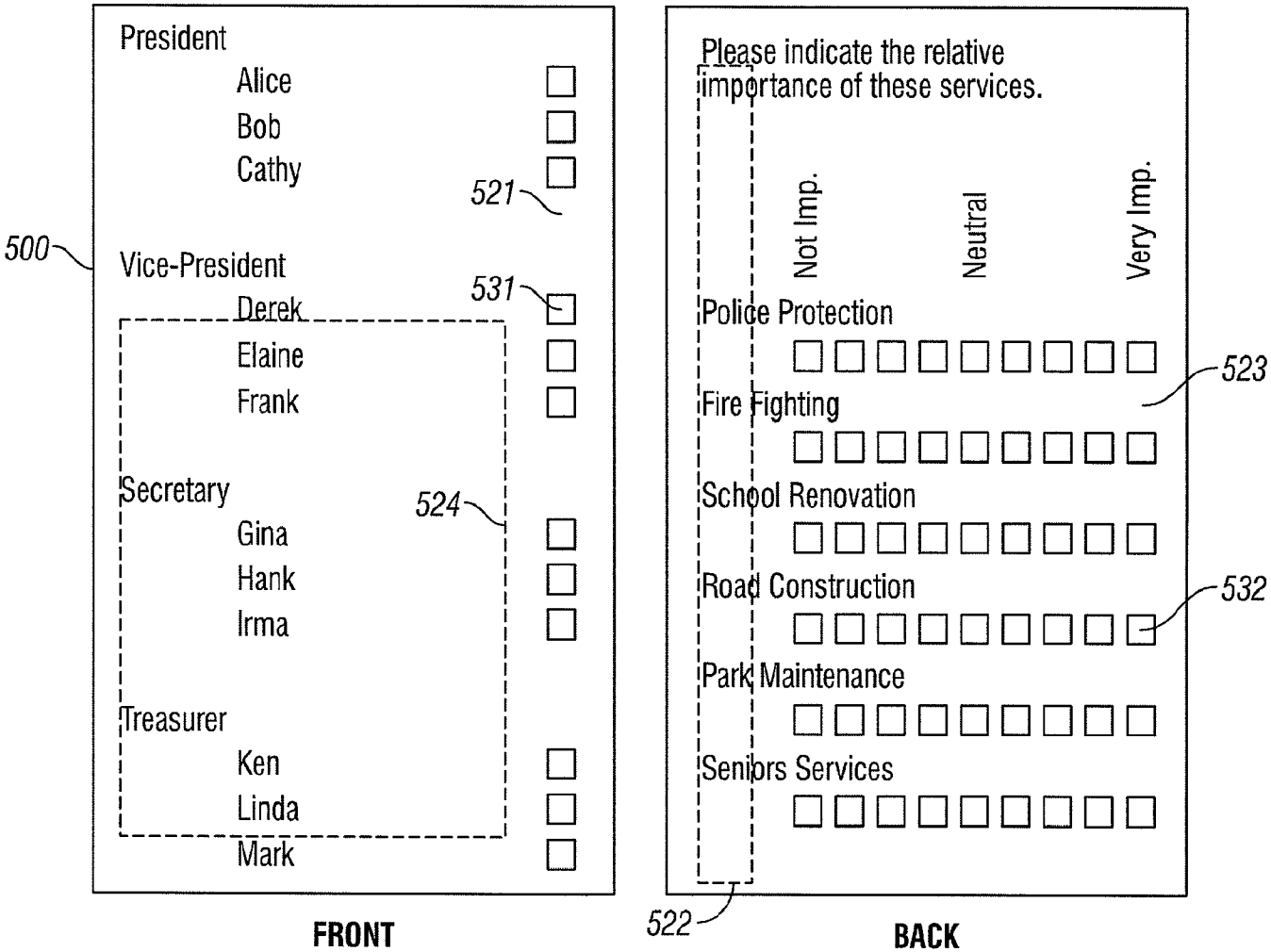
FIG. 2A is a visual representation of a ballot taking advantage of a technique for thermally marking a ballot on both sides according to some embodiments of the invention.

FIG. 2A shows a visual representation of a technique for thermally marking a ballot on both sides according to the invention. In this example, the thermochromic medium is described as a ballot 500 based on a paper substrate. However, it will be readily apparent to those possessing ordinary skill in the art that any thermochromic medium may benefit from the technique.

In this technique, a thermochromic coating is applied to selected regions on each side of the substrate in an exclusionary fashion. According to these techniques, no region of paper exists in which thermally sensitive coatings are applied to both sides of the paper. On the front of the ballot 500, the sets of candidates running for several offices are press printed at left. The boxes 531 for indicating a voter's preference for a particular candidate are press printed in a vertical column at right. The entire column of boxes is backed by a thermochromic coating 521. On the back of the ballot, a series of services are press printed below a set of press printed instructions, and a set of boxes 532 for indicating the voter's perceived importance of each service is press printed below each service. The sets of boxes, and portions of the printed services, are backed by a thermochromic coating. The thermochromic coatings applied to each side are offset from one another. That is, the region 522 opposing the coated region 521 on the front of the ballot is free of thermochromic coating, and the region 524 opposing the coated region 523 on the back of the ballot is free of thermochromic coating. This exclusionary approach to applying the thermochromic coating ensures that when marks are created on one side of the ballot, no unintended marks are produced on the opposing side of the ballot.

Figure 2B:
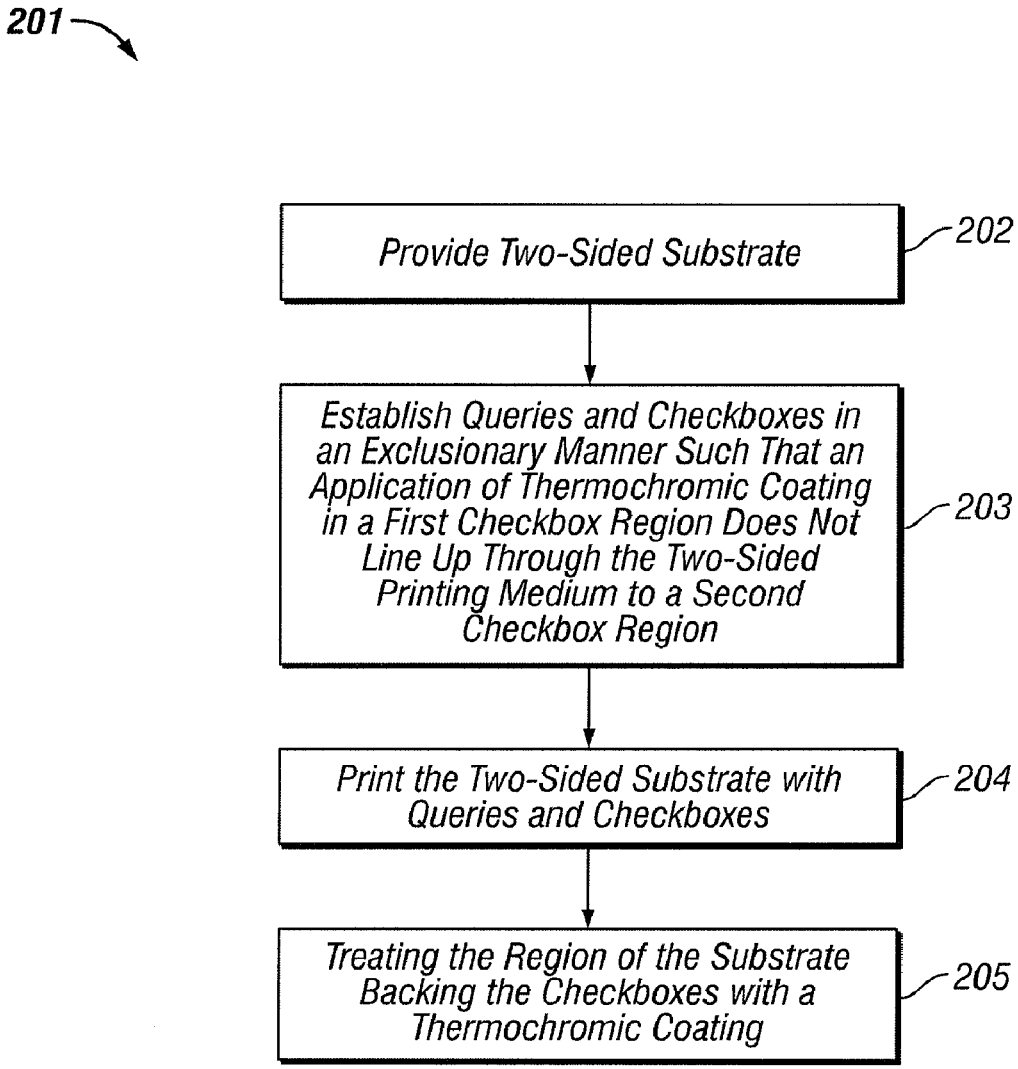
FIG. 2B illustrates the steps of a method of designing a two-sided thermochromic medium according to some embodiments of the invention.

FIG. 2B illustrates the steps of a method 201 of designing a two-sided thermochromic medium according to some embodiments of the invention. In some embodiments of the invention, the two-sided thermochromic medium is a voting ballot. However, it will be readily apparent to those having ordinary skill in the art having the benefit of this disclosure, that the method of designing a two-sided thermochromic medium is useful in a variety of other applications.

The method begins with providing a two-sided substrate at step 202. The method 201 continues by establishing various queries and checkboxes at step 203, wherein the checkboxes accept one or more indicia representing a response to the various queries. In some embodiments of the invention, two sets of queries and corresponding checkboxes are established, wherein the one set is positioned on the front of the two-sided thermochromic medium and the second set is positioned on the back of the two-sided printing medium. In the presently preferred embodiment the first checkbox region does not line up through the two-sided printing medium to a thermochromic coating in a second checkbox region. Rather, the queries and checkboxes are designed and established in an exclusionary manner such that an application of thermochromic coating in a first checkbox region does not line up through the two-sided printing medium to a second checkbox region.

It will be readily apparent to those having ordinary skill in the art having the benefit of this disclosure that a wide variety and number of sets of queries and corresponding checkboxes are able to be positioned in a similar exclusionary manner on a wide variety of positions on the medium.

At step 204 the method 201 continues with printing the two-sided substrate with the established queries and checkboxes. In the presently preferred embodiment of the invention, the queries and checkboxes are press printed. However, it will be readily apparent to those having ordinary skill in the art having the benefit of this disclosure that a variety of printing methods, now known or later developed, may be used to print the queries and checkboxes.

The method of designing a two-sided thermochromic medium 201 continues with treating the region of the substrate backing the checkboxes with a thermochromic coating at step 205.

Figure 2C:
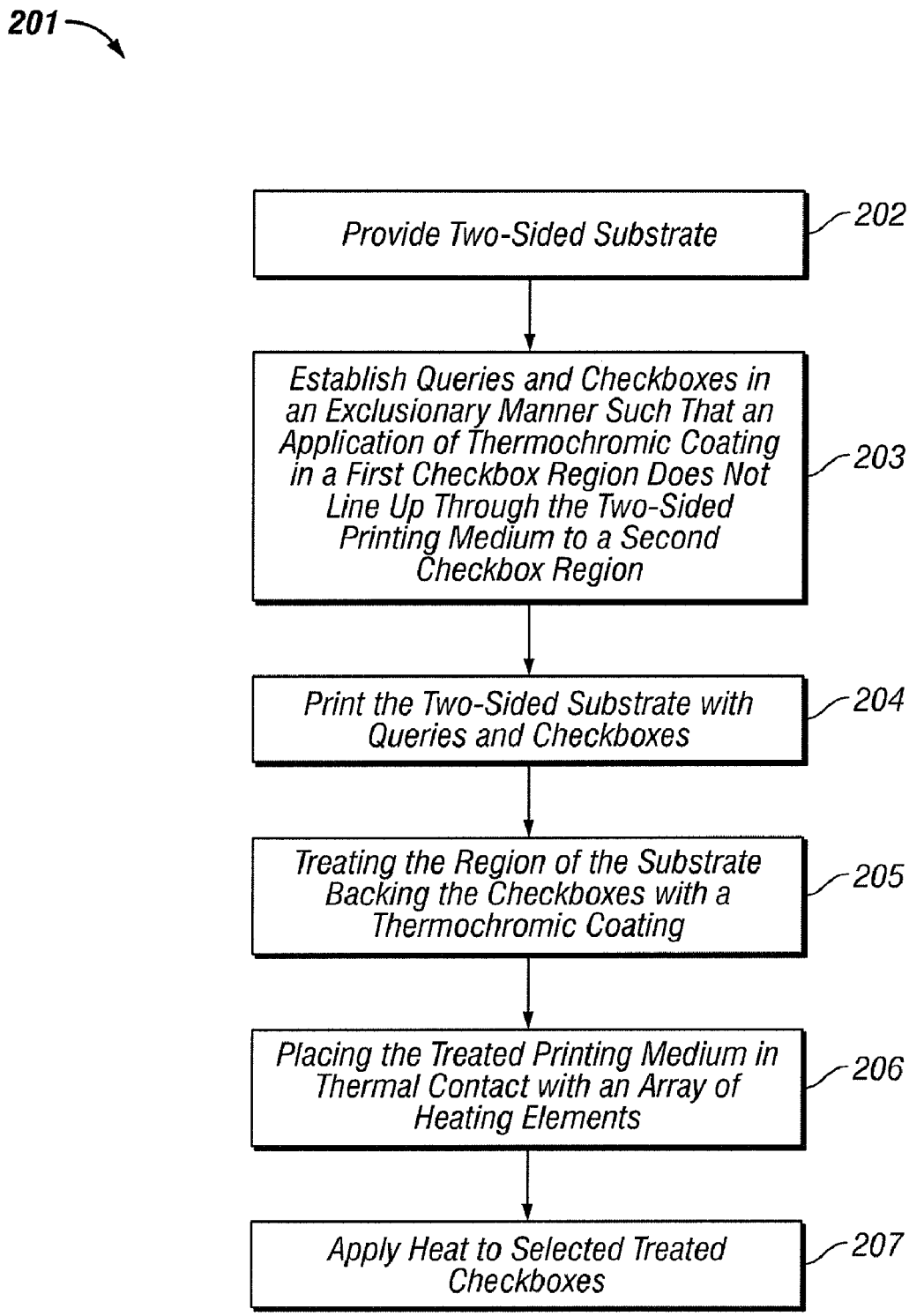
FIG. 2C illustrates the steps for a method of designing a two-sided thermochromic medium and thermally printing marks on checkboxes according to some embodiments of the invention.

FIG. 2C illustrates a similar method 201' of designing a two-sided thermochromic medium and thermally printing marks on checkboxes according to some embodiments of the invention. According to FIG. 2C, steps 202, 203, 204, and 205 are repeated from the method 201 of FIG. 2B. Additionally, the method continues with placing the treated printing medium in thermal contact with an array of heating elements at step 206 and applying heat to various checkboxes at step 207, thus printing marks.

In some other embodiments of the invention, the methods 201 and 201' further comprise providing at least one orientation indicator on the thermal printing medium. As explained below, orientation indicators are employed to detect the orientation of a thermal printing medium such that the thermal printing medium is marked accurately irrespective of its orientation relative to the HEA. According to these embodiments, the thermal printing system is more user-friendly.

Figure 3A:
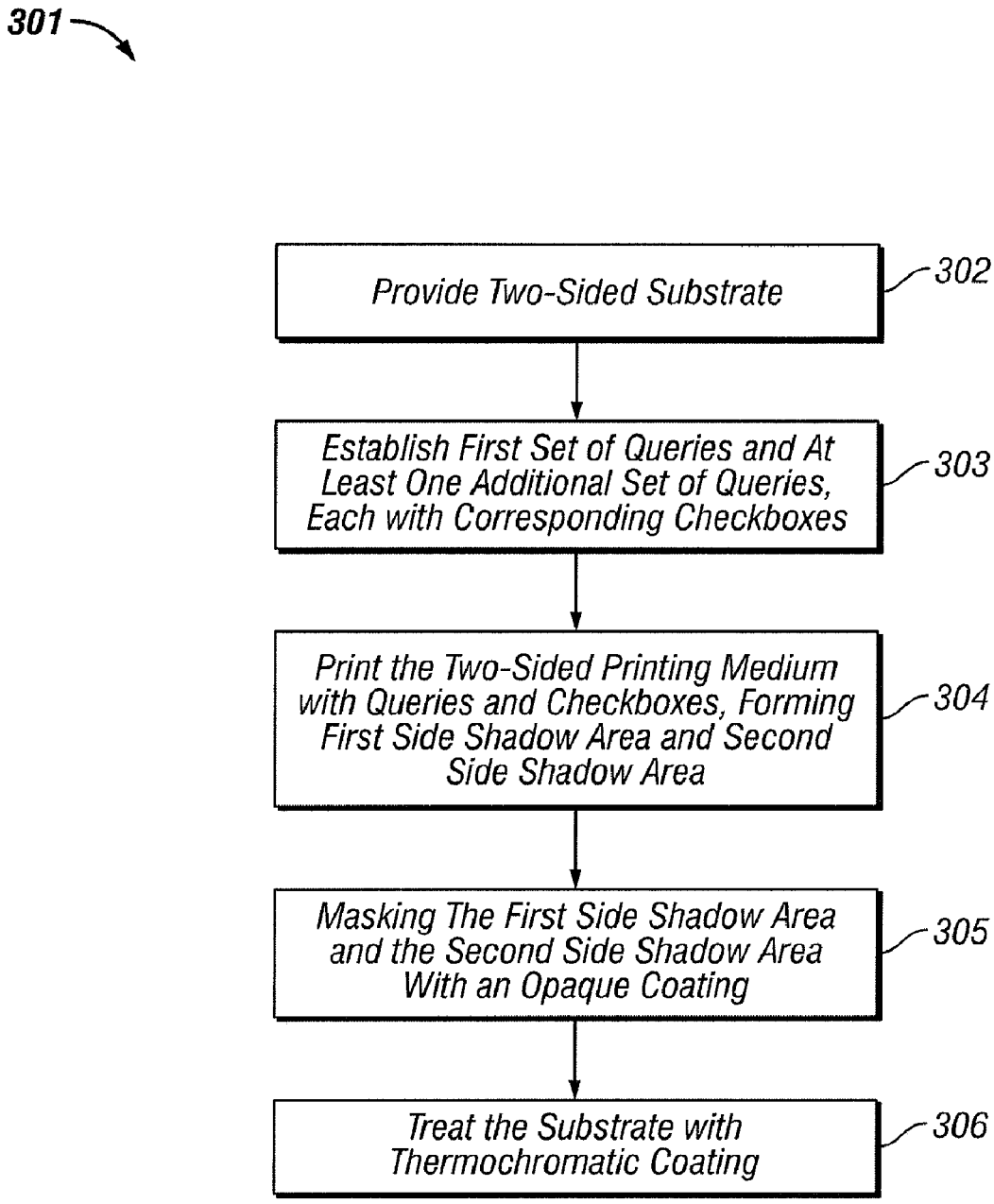
FIG. 3A illustrates the steps for a method of designing a two-sided thermochromic medium according to some embodiments of the invention.
Figure 3B:
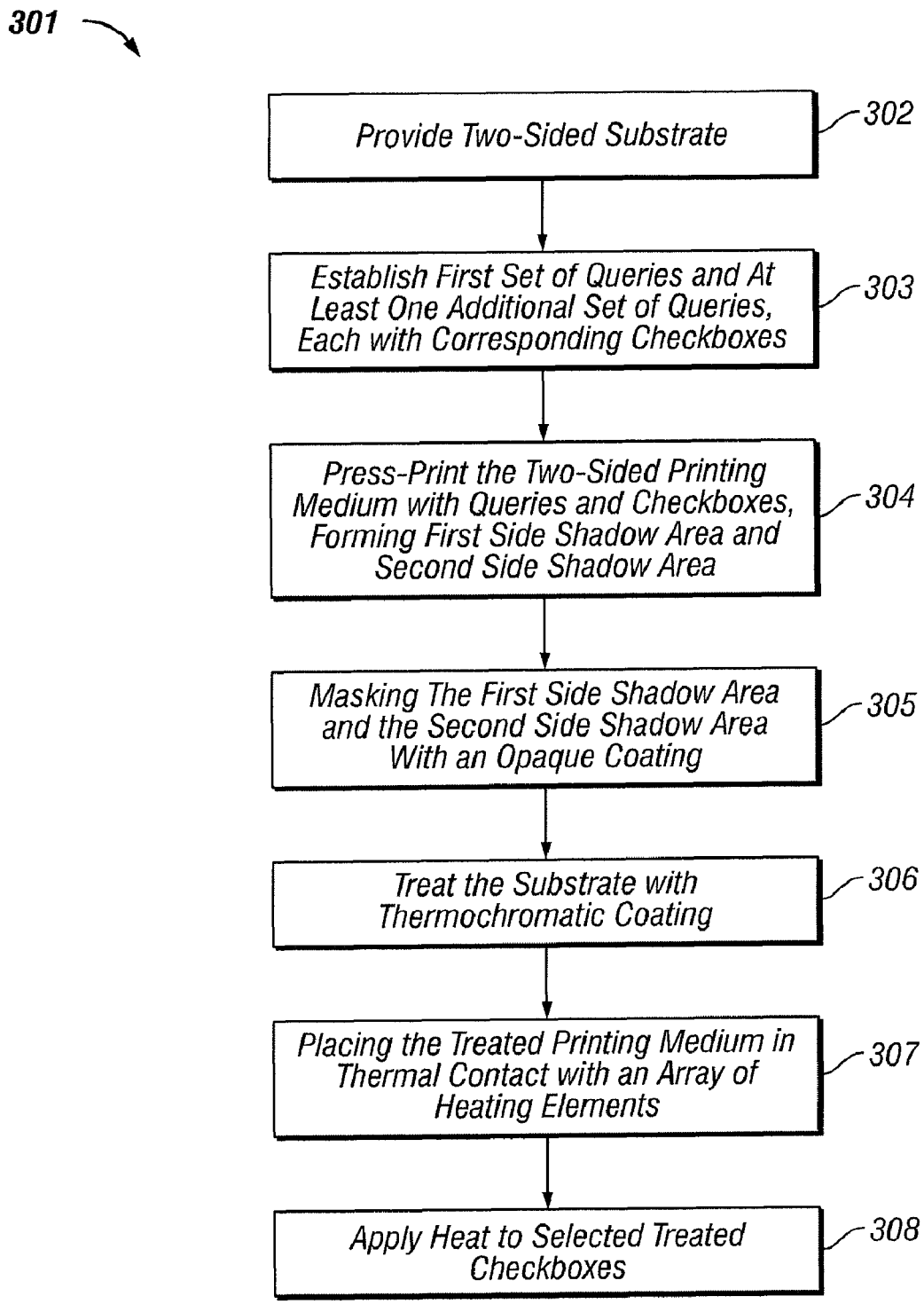
FIG. 3B illustrates the steps for a method of designing a two-sided thermochromic medium and thermally printing marks on checkboxes according to some embodiments of the invention.

FIGS. 2B and 2C illustrate one way to designing a printable medium such that markings are not visible through the printable medium. FIGS. 3A and 3B illustrate another method of printing unintended marking through the use of masking. Similarly, 3C illustrates a printable medium taking advantage of these masking methods.

FIG. 3A illustrates the steps of a method 301 of designing a two-sided thermochromic medium using a substantially opaque masking according to some embodiments of the invention. In some embodiments of the invention, the two-sided thermal printing medium is a voting ballot. However, it will be readily apparent to those having ordinary skill in the art having the benefit of this disclosure, that the method of designing a two-sided thermochromic medium is useful in a variety of other applications.

The method begins with providing a two-sided substrate at step 302. The method 301 continues by establishing various queries and checkboxes at step 303, wherein the checkboxes accept one or more indications representing a response to the various queries. Two sets of queries and corresponding checkboxes are established, wherein the one set is positioned on the front of the two-sided printing medium and the second set is positioned on the back of the two-sided printing medium.

At step 304 the method 301 continues with printing the two-sided substrate with the established queries and checkboxes. In the presently preferred embodiment of the invention, the queries and checkboxes are press printed. However, it will be readily apparent to those having ordinary skill in the art having the benefit of this disclosure that a variety of printing methods, now known or later developed, may be used to print the queries and checkboxes. The step 304 of printing one or more checkboxes results in creating one or more "shadow areas" on the opposite side of the printable medium. The shadow areas comprise the area on the opposite side of the printable medium that is vulnerable to an unintended mark caused by heating the opposing checkbox area.

The method 301 continues with the step 305 of masking the first side shadow area and the second side shadow area with a substantially opaque coating. As used herein, the term "opaque" refers to a condition of a region on the printable medium in which a mark caused by the heating a thermochromic coating in that region is unnoticeable. In some embodiments, the opaque coating comprises dark ink. The benefit of this masking technique is that a user can simply treat the entirety of both sides with the thermochromic coating, resulting in an easier and less expensive coating process. Furthermore, the masking ensures that the marks coming through to an unintended side of the printing medium are not visible.

The method of designing a two-sided thermochromic medium 301 continues with treating the substrate with a thermochromic coating at step 306. In some embodiments of the invention, at least the checkboxes are treated with the thermochromic coating. In some other embodiments of the invention the entire substrate is treated with the thermochromic coating thereby resulting in an easier treatment process.

FIG. 3B illustrates a method 301' of designing a two-sided thermochromic medium and thermally printing marks on checkboxes according to some embodiments of the invention. According to FIG. 3B, steps 302, 303, 304, 305, and 306 are repeated from the method 301 of FIG. 3A. Additionally, the method continues with placing the treated printing medium in thermal contact with an array of heating elements at step 307 and applying heat to various checkboxes at step 308, thus printing marks.

In some other embodiments of the invention, the methods 301 and 301' further comprise providing at least one orientation indicator on the thermal printing medium. As explained below, orientation indicators may be employed to detect the orientation of a thermal printing medium such that the thermal printing medium may be marked accurately irrespective of its orientation within the HEA. According to these embodiments, the thermal printing system is more user-friendly.

Figure 3C:
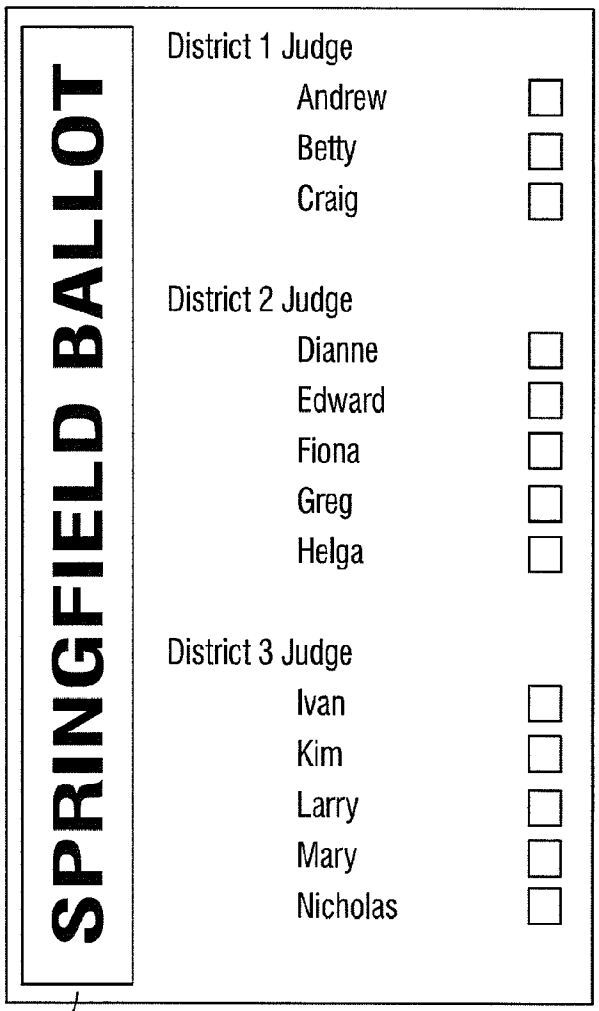
FIG. 3C is a visual representation of a ballot taking advantage of an alternative technique for thermally marking a ballot on both sides according to some embodiments of the invention.
Figure 3C:
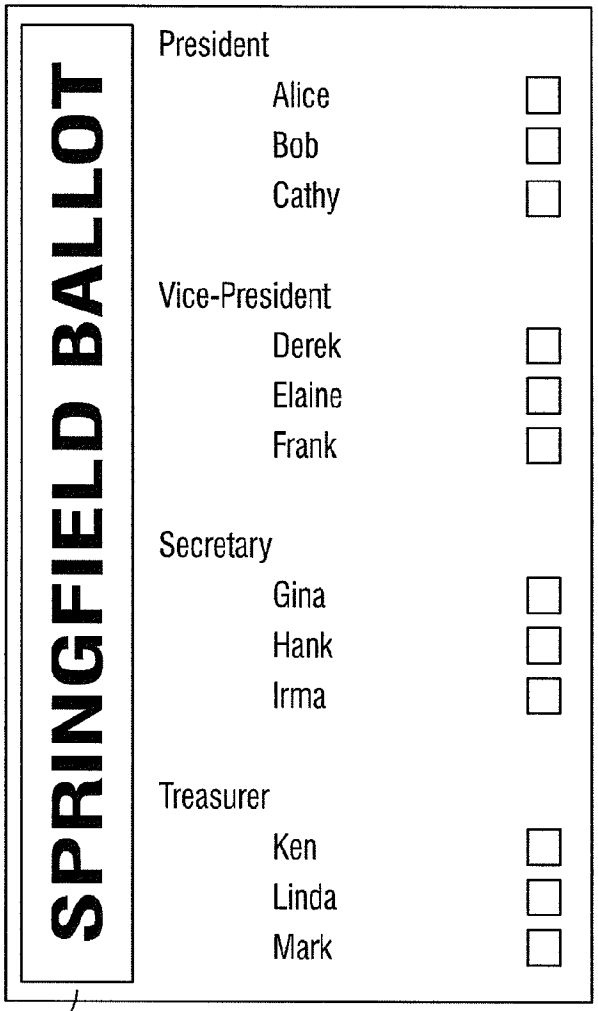

FIG. 3C shows a ballot resulting from the masking technique for thermally marking a printable medium on both sides according to the invention. Again, although the thermochromic medium is described as a ballot, it will be readily apparent to those possessing ordinary skill in the art that any thermochromic medium may benefit from the technique. In any region where thermal marking may occur on one side, an opaque ink is applied to the opposing side's shadow area to ensure that any unintentional thermal markings on the opposing side are masked. On both the front and back of the ballot shown in FIG. 3C, the sets of candidates running for several offices are press printed at left, and voter preferences are thermally marked in a column of boxes at right. Because marks within these boxes may produce a marking on the opposing side of the ballot, dark-colored opaque vertical bars 561 and 562 are press printed in the shadow area.

In the above approaches, the ability to thermally mark both sides of the thermochromic substrate allows the ballot designer to utilize the increased surface area offered by both sides of the ballot. The invention presupposes that heat will in fact conduct through the paper and the invention prevents unintentional marking on the opposing side by the masking. Thus, according to some embodiments of the invention, the paper can be marked on both sides using heating elements on only one side of the paper. This significantly speeds and simplifies the printing process in that the paper need not be flipped, either automatically or by the voter, before printing on the second side.

Ballot and Heating Element Array Positioning Techniques

Figure 4A:
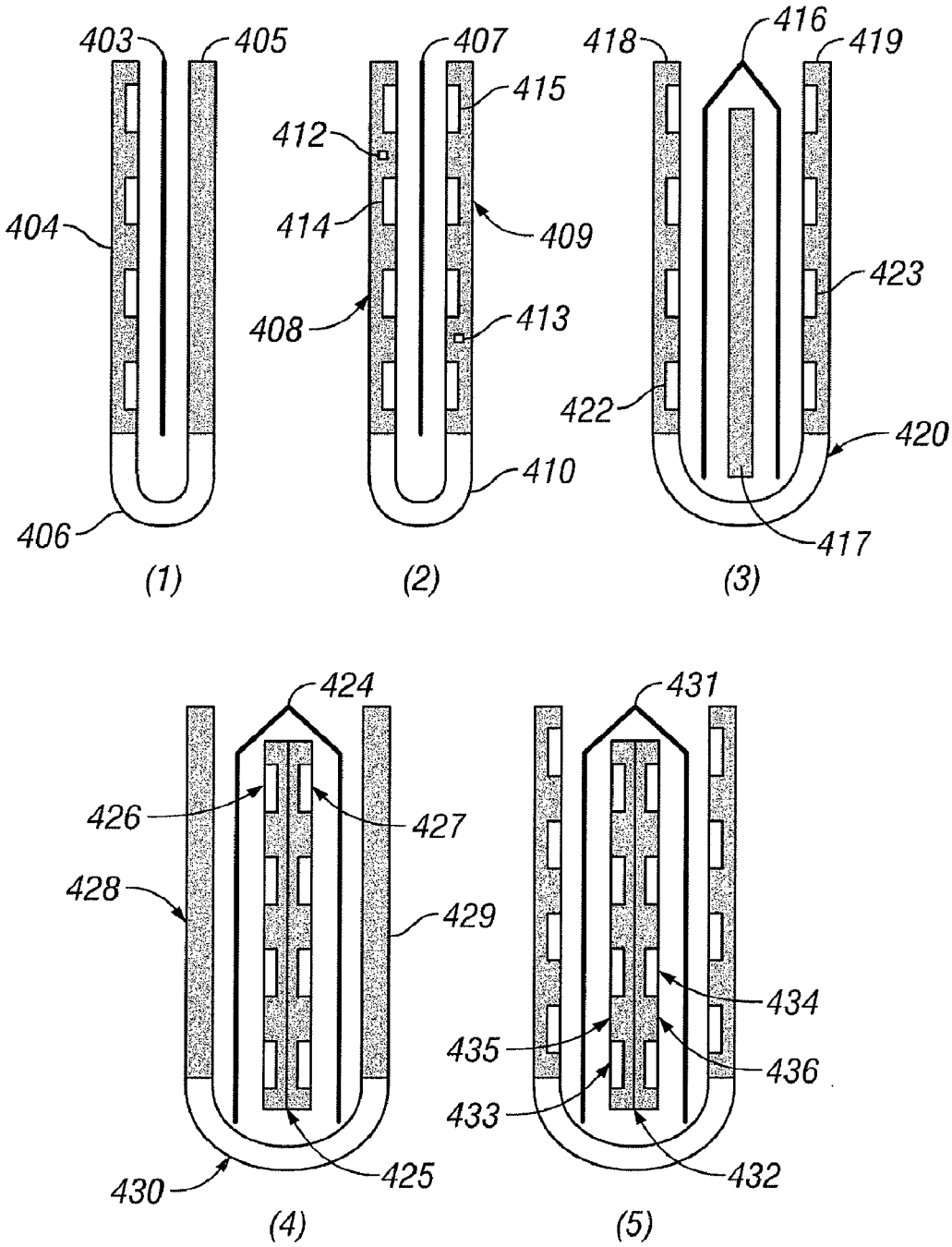
FIG. 4A shows several configurations ensuring reliable contact between a substrate and a heating element array according to various embodiments of the invention.

FIG. 4A shows several heating element array (HEA) configurations ensuring reliable contact between a thermochromic medium and the HEA according to some embodiments of the invention. In the following examples, the thermochromic medium is described as a ballot, however, it will be readily apparent to those possessing ordinary skill in the art that any thermochromic medium may benefit from the technique.

1. HEA-Insulator Clamshell Around Ballot

In some embodiments of the invention, a ballot 403 is clamped between an HEA 404 and an insulator 405 connected by a hinge 406. The insulator 405 ensures firm, uniform contact between the ballot 403 and the HEA 404 and minimizes the transfer of heat away from the marked regions, thereby reducing any bleeding of the marks produced. If the ballot 403 is formed of sufficiently insulative paper, this configuration allows for full-coverage marking on one side of the ballot 403. If more conductive paper is used, this configuration allows for full-coverage, identical marking or exclusionary, distinct marking on opposing sides of the ballot 403, as described above.

2. HEA Clamshell Around Ballot

In some embodiments of the invention, a ballot 407 is clamped between two HEAs 408, 409 connected by a hinge 410. An insulating substrate 412, 413 is disposed between the heating elements 414, 415 within the HEAs 408, 409. The insulating substrate minimizes conduction of heat away from the marked regions of the ballot 407. If the ballot 407 is formed of sufficiently insulative paper, this configuration allows for full-coverage, distinct marking on both sides of the ballot 407. If more conductive paper is used, this configuration allows for full-coverage, identical marking or exclusionary, distinct marking on opposing sides of the ballot 407.

3. HEA Clamshell Around Ballot Folded Around Insulator

In some embodiments of the invention, a ballot 416 is folded around an insulator 417. The folded ballot 416 is clamped between two HEAs 418 and 419 connected by a hinge 420. Heating elements 422, 423 within the HEAs 418, 419 thus mark onto the exterior side of the folded ballot 416. The insulator 417 prevents marking of one half of the folded ballot by the HEAs 422, 423 adjacent to the complementary half of the folded ballot 416. The insulating substrate 417 between the heating elements 422, 423 within the HEAs 418, 419 minimizes conduction of heat away from the marked regions. If the ballot 416 is formed of sufficiently insulative paper, this configuration allows for full-coverage marking on the exterior side of the folded ballot 416. If more conductive paper is used, this configuration allows for full-coverage, identical marking or exclusionary, distinct marking on both exterior and interior sides of the ballot 416. In allowing for a folded ballot 416, this configuration reduces the effective size of the ballot 416, thus easing voter handling of the ballot 416 without reducing the markable area. Furthermore, if only the exterior side of the folded ballot 416 is marked, voter privacy can be enhanced by inverting the folded ballot 416 upon removal from the ballot marking device.

4. Insulator Clamshell Around Ballot Folded Around Two-Sided HEA

In some embodiments of the invention, a ballot 424 is folded around a two-sided HEA 425. The two-sided HEA 425 may be constructed from a single insulating substrate, e.g. a PCB, with heating elements 426, 427 on either side, or from two single-sided HEAs abutted against one another with heating elements facing outward toward the interior side of the folded ballot 424. The two-sided HEA thus marks onto the interior side of the folded ballot 424. The folded ballot 424 is preferably clamped between two insulators 428, 429 that are connected by a hinge 430. The insulators 428 and 429 ensure firm, uniform contact between the folded ballot 424 and the heating elements 426, 427 within the two-sided HEA 425 and minimize conduction of heat away from the marked regions. If the ballot 424 is formed of sufficiently insulative paper, this configuration allows for full-coverage marking on the interior side of the folded ballot 424. If more conductive paper is used, this configuration allows for full-coverage, identical marking or exclusionary, distinct marking on both interior and exterior sides of the folded ballot 424. In allowing for a folded ballot 424, this configuration reduces the effective size of the ballot 424, thus easing voter handling of the ballot 424 without reducing the markable area. Furthermore, if only the interior side of the folded ballot 424 is marked, voter privacy is enhanced.

5. HEA Clamshell Around Ballot Folded Around Two-Sided HEA

In some embodiments of the invention, a ballot is folded around a two-sided HEA 432. The two-sided HEA 432 may be constructed from a single insulating substrate, e.g. a PCB, with heating elements 433, 434 on either side, or two single-sided HEAs abutted against one another with heating elements 433, 434 facing outward toward the interior side of the folded ballot 431. The insulating substrates 435 and 436 positioned between the heating elements 433 and 434 of the HEA 432 minimize conduction of heat away from the marked regions. If the ballot 431 is formed of sufficiently insulative paper, this configuration allows for full-coverage marking on both the interior and exterior sides of the folded ballot 431. If more conductive paper is used, this configuration allows for full-coverage, identical marking or exclusionary, distinct marking on both interior and exterior sides of the folded ballot 431. In allowing for a folded ballot 431, this configuration reduces the effective size of the ballot 431, thus easing voter handling of the ballot 431 without reducing the markable area. Furthermore, if only the interior side of the folded ballot 431 is marked, voter privacy is enhanced.

Figure 4B:
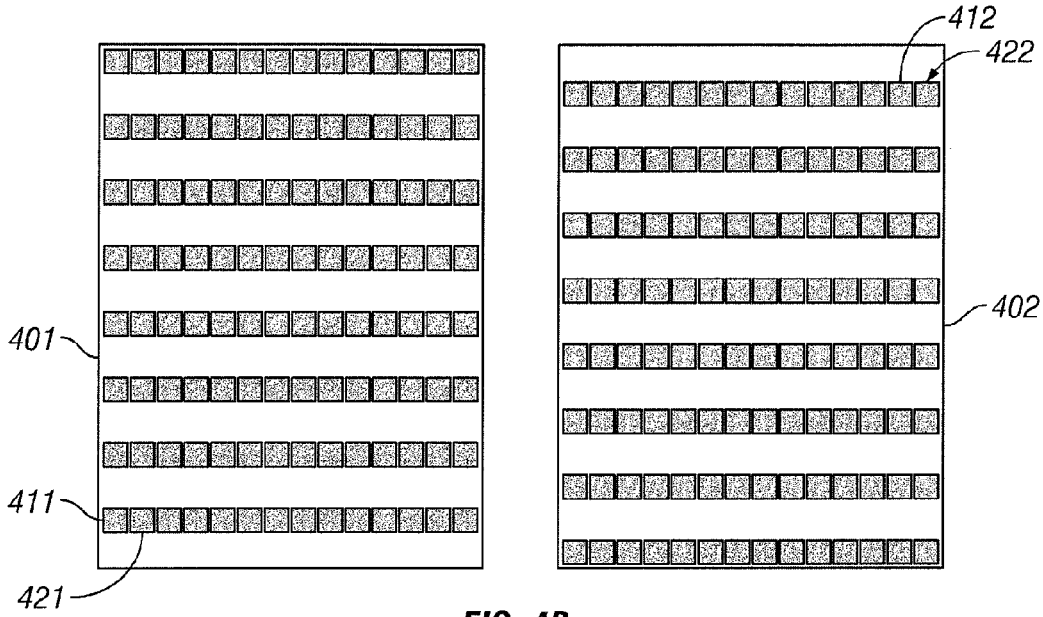
FIG. 4B is an isometric view of two printed circuit boards having heating elements disposed on one side of each board according to some embodiments of the invention.

It will be readily apparent to those having ordinary skill in the art and having the benefit of this disclosure, that the examples given above in (1)-(5) are merely some possible configurations. It will be obvious to ordinary practitioners that other configurations of heating element arrays are envisioned to accomplish a wide variety of design specific goals that may present themselves. For example, FIG. 4B is an isometric view of two PCBs 401 and 402 with heating elements 411, 421, 412, and 422 disposed on one side of each board. The two PCBs 401 and 402 illustrated in FIG. 4B are disposed facing each other, such that a thermochromic medium 499 inserted between the PCBs is exposed to heating elements on each side. In some embodiments the heating elements are "nested" within the substrate or insulator. Furthermore, the two PCBs 401 and 402 have alternating rows of heating elements such that any one region on the medium placed between the PCBs is only heated by one of the PCBs 401 or 402.

Figure 4C:
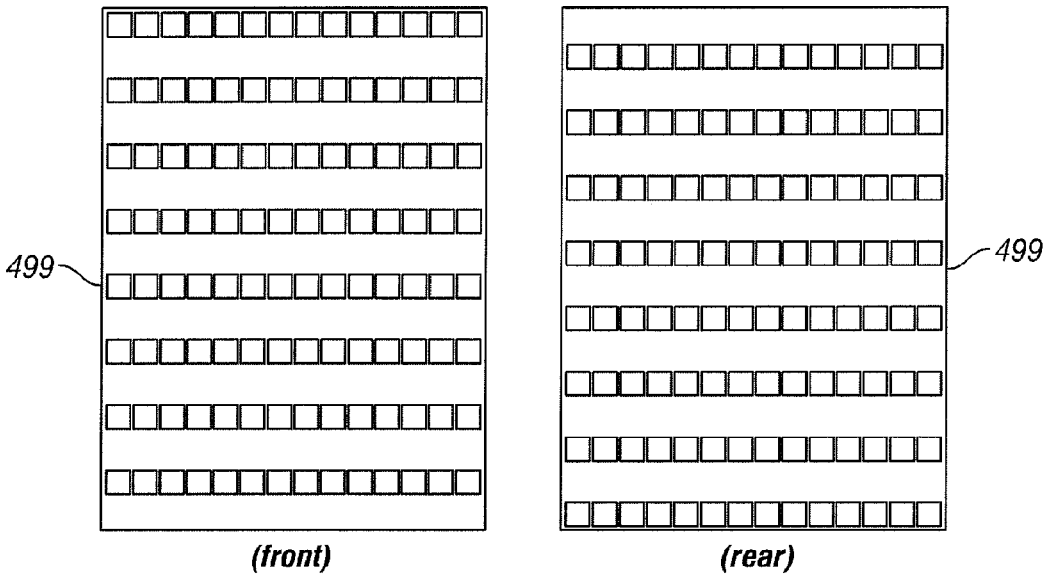
FIG. 4C shows front and rear views of a thermochromic medium used with the heating element apparatus shown in FIGS. 4B and 4D.

As shown in FIG. 4C, the thermochromic medium 499 has checkboxes in rows on both the front and rear side disposed in an alternating fashion. In the presently preferred embodiment of the invention, the check boxes are individually treated with a thermochromic coating such that the check boxes are marked with the application of heat from a heating element. According to these embodiments, the invention utilizes the alternating rows of heating elements and the alternating rows of coated checkboxes to cause heat by one or more heating elements to make a marking without inadvertently marking a checkbox on the opposing side of the ballot.

Receiving Ballot and Determining Ballot Orientation

Figure 5:
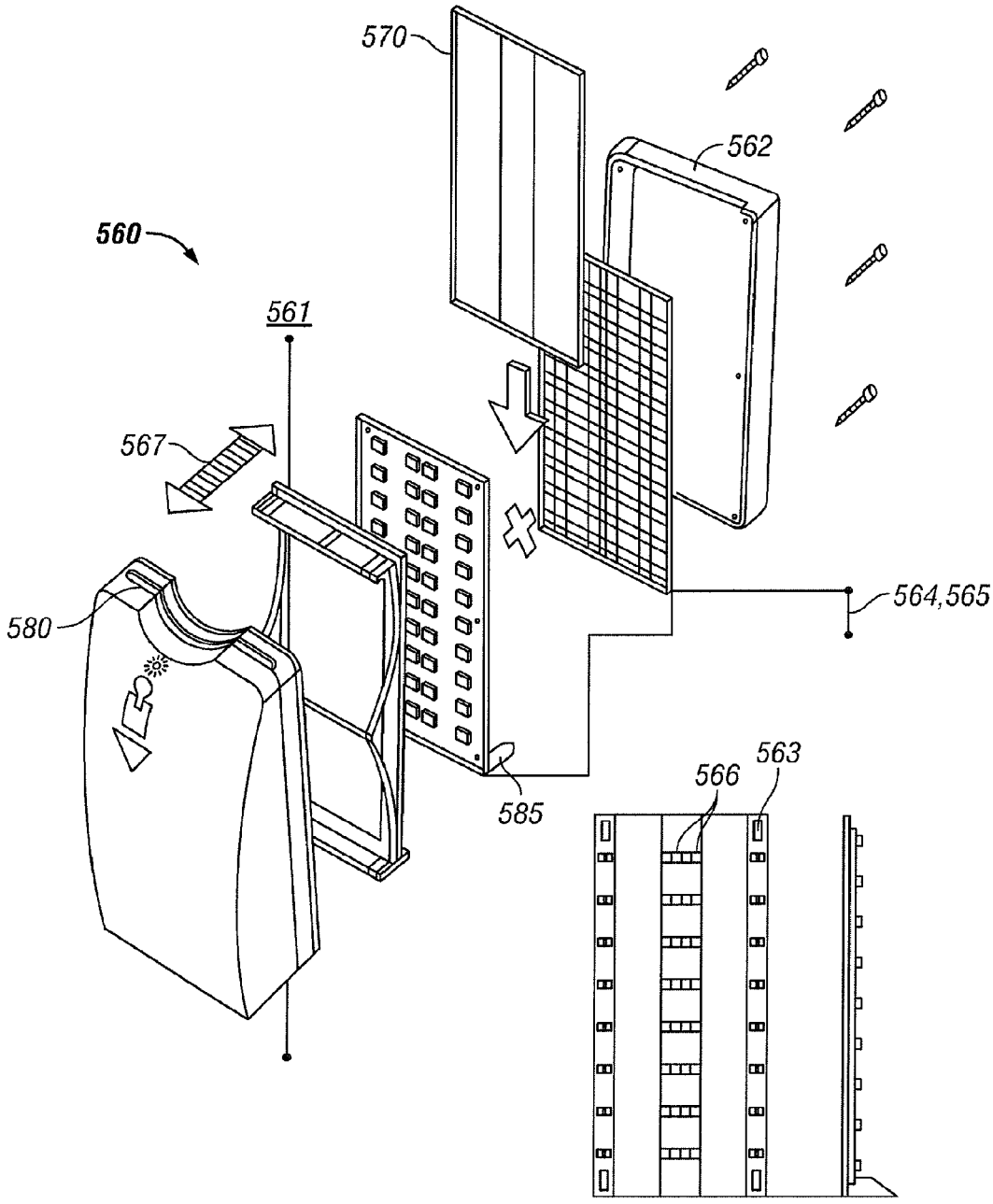
FIG. 5 is an isometric view of a voting machine according to some embodiments of the invention.

The invention further provides mechanisms for receiving an unmarked ballot from the voter and determining the orientation of the received ballot. FIG. 5 shows a voting machine 560 according to some embodiments of the invention. In the presently preferred embodiment of the invention, the voting machine 560 includes a pair of opposing PCBs 564 and 565 with heating element arrays 566. The PCBs also includes paper orientation sensors 563, e.g. surface mount LED and receiver pairs, at each corner. In some embodiments, the PCBs are mechanically coupled to a pressing mechanism 561 and rear housing member 562, with a spring providing a clamping action 567 forcing the PCBs against one another.

Figure 4D:
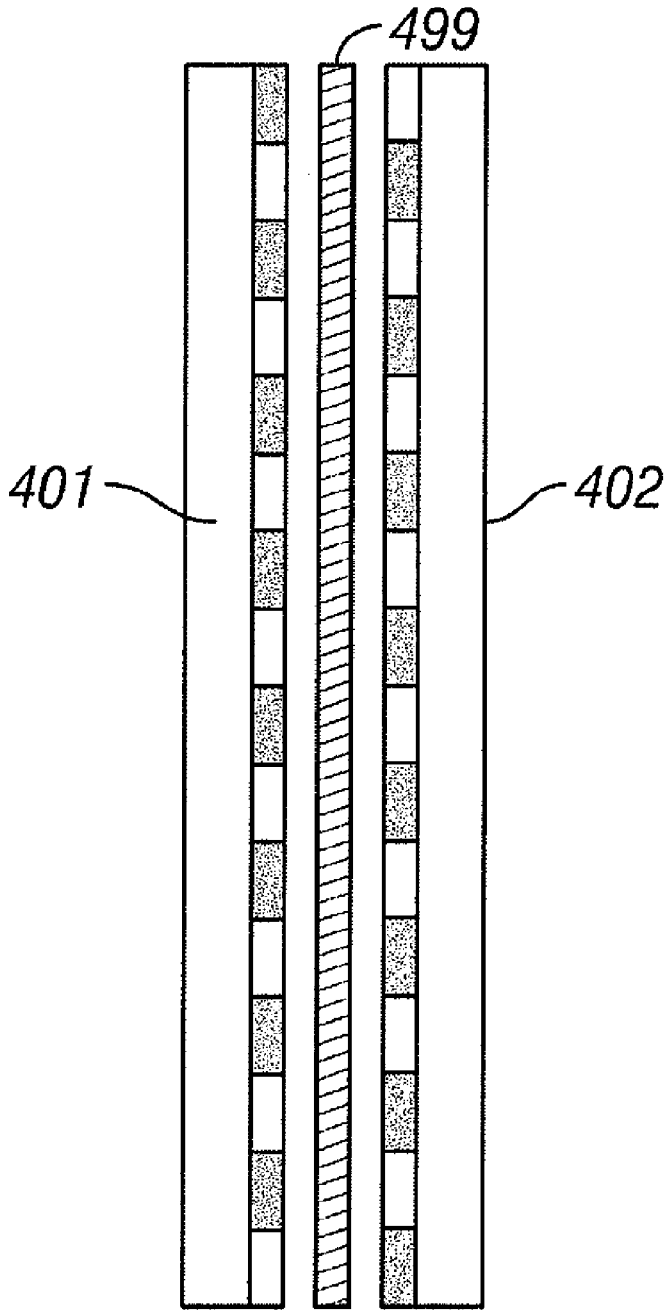
FIG. 4D is a side view of two printed circuit boards having heating elements disposed on one side of each board with a thermochromic medium disposed therebetween according to some embodiments of the invention.

According to FIG. 5, a user inserts a ballot 570 in an opening 580 above the PCBs 564 and 565 and between the pressing mechanism 561 and the rear housing member 562. The opening 580 is positioned such that the lower edge of the ballot comes to rest in a seam between the two PCBs which, initially, are in contact with one another. The voter then pulls a lever (not shown), mechanically connected to the pressing mechanism 561, to separate the PCBs 564 and 565 in opposition to the spring. The ballot 570 falls downward between the PCBs 564 and 565, and comes to rest against a stop 585. The lever is released and the ballot 570 is firmly clamped by the PCBs 564 and 565. One skilled in the art will appreciate that this approach is readily adapted to the ballot and HEA positioning schemes of FIGS. 4A and 4D.

After the ballot is received from the voter, the orientation sensors 563 then inspect the ballot to confirm proper insertion and determine the orientation of the inserted ballot. The sensors detect the presence or absence of orientation indicators on the inserted ballot. The relative positions of the sensors match the relative positions of the locations on the ballot where orientation indicators may be present.

Figure 6:
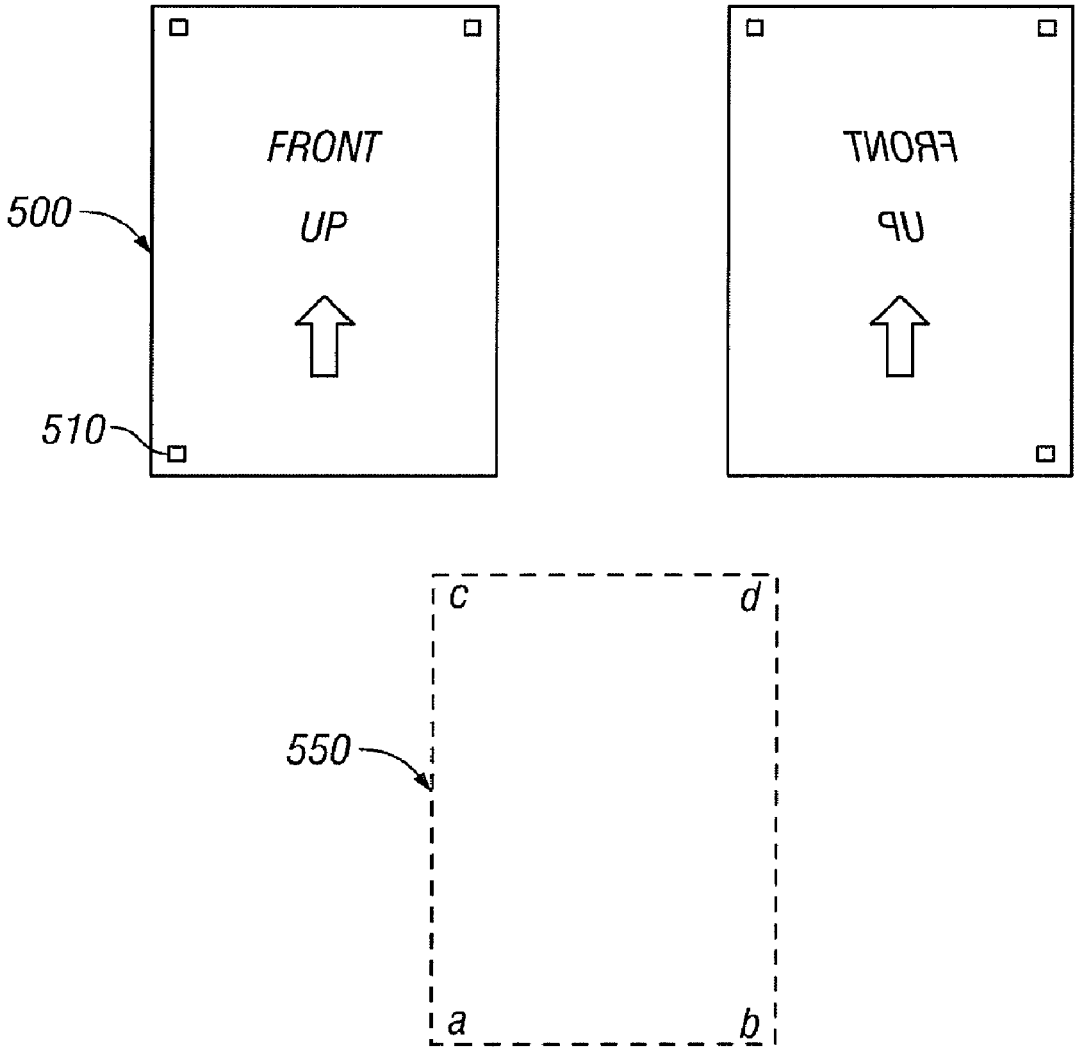
FIG. 6 illustrates a ballot labeling scheme and associated sensor positions for orienting a ballot according to some embodiments of the invention.

FIG. 6 shows a ballot labeling scheme and associated sensor positions for orienting a ballot according to the invention. In this scheme, orientation indicators are printed in several corners of the ballot. Specifically, orientation indicators 510 are printed in the lower left, upper left, and upper right corners of the front side of the ballot 500, and orientation indicators are printed in the lower right, upper left, and upper right corners of the back side of the ballot, as shown. Here, "front", "back", "upper", and "lower" are defined relative to the printed matter, e.g. a set of candidate's names and corresponding checkboxes, on the ballot. Also shown in FIG. 6 are the four sensor positions a, b, c, and d, corresponding to the four corners of the ballot when in the inserted position. The indicators may be markings, as shown in FIG. 6 or may be holes punched through the ballot.

Figure 7:
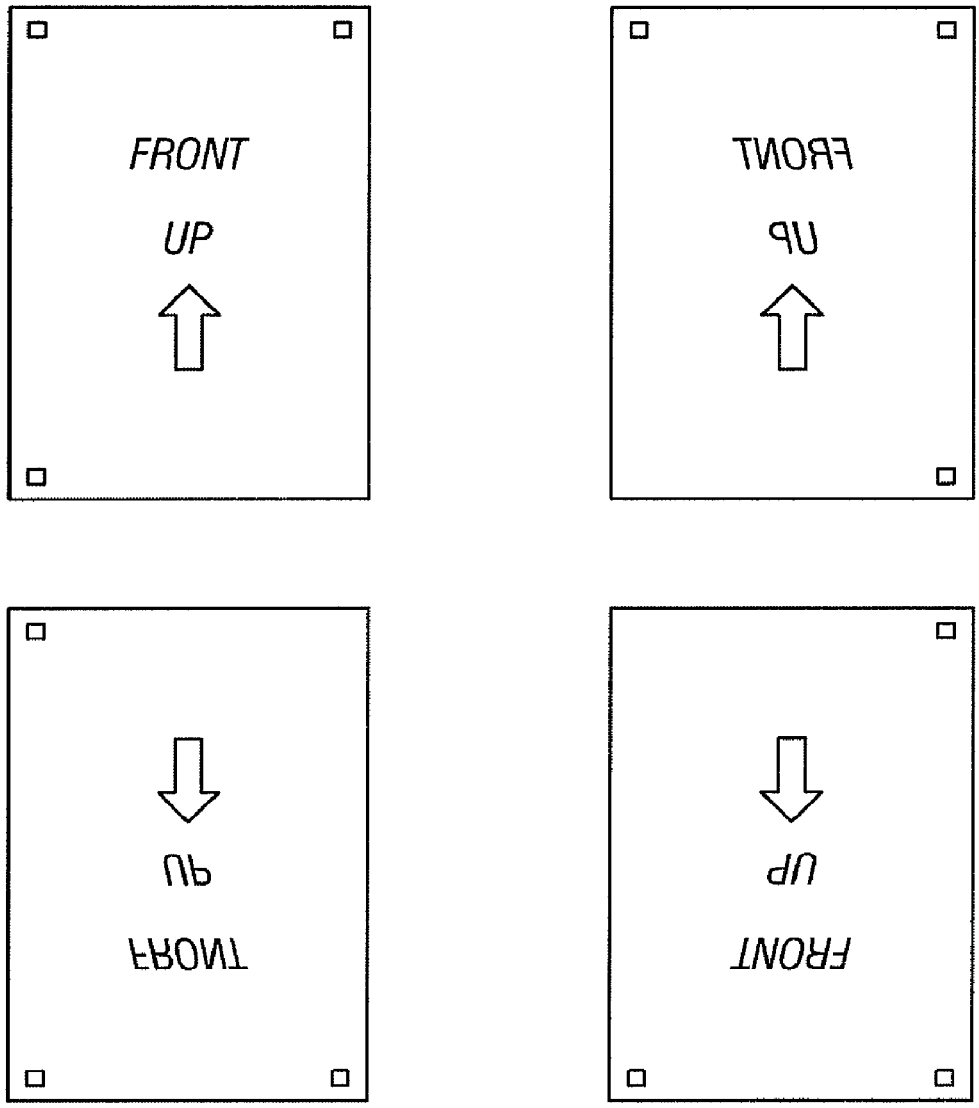
FIG. 7 illustrates four possible ballot orientations capable of being identified by a thermal printing machine according to some embodiments of the invention.

FIG. 7 shows four possible ballot orientations. Table 1 shows the sensor readings a, b, c, and d corresponding to an improper ballot insertion and the four possible orientations of FIG. 7. Here, 1 corresponds to the detection of an orientation indicator and 0 corresponds to no detection of an indicator. The uniqueness of the rows indicates that each of the four orientations can be uniquely determined given the pattern of orientation indicators and arrangement of sensors shown in FIG. 6. It should be noted that the scheme described above is also tolerant of a single sensor failure—either "fail-on" or "fail-off".

TABLE 1

Sensor readings and corresponding orientations.

| | Sensor | | | |
|---|---|---|---|---|
| Orientation | a | b | c | d |
| No Ballot | 0 | 0 | 0 | 0 |
| Front Up | 1 | 0 | 1 | 1 |
| Back Up | 0 | 1 | 1 | 1 |
| Back Down | 1 | 1 | 1 | 0 |
| Front Down | 1 | 1 | 0 | 1 |

The ballot marking device may proceed with marking the ballot once the orientation of the ballot is determined. The manner in which the heating elements are addressed, however, is adapted to reflect the determined orientation of the ballot. For example, if the ballot marking device uses the ballot and HEA configuration of FIG. 4A-(2) and the inserted ballot is a one-sided ballot formed of paper sufficiently insulative as to permit one-sided marking, only one of the two HEAs will be addressed to mark the ballot. Specifically, only the HEA facing the printed side of the ballot is addressed during marking. If the inserted ballot is a two-sided ballot formed of paper sufficiently insulative as to permit one-sided marking, both HEAs are addressed and the marking pattern with which each HEA is addressed is based on the side of the ballot facing the HEA.

Additionally, the marking patterns with which the HEAs are addressed may need to be inverted vertically based upon the ballot orientation. If instead the ballot marking device uses the ballot and HEA configuration of FIG. 4A-(1), the pattern with which the HEA is addressed is inverted either horizontally, vertically, or horizontally and vertically based on the ballot orientation. If all ballot orientations are to be accepted using the configuration of FIG. 4A-(1), however, the ballot must be formed of paper sufficiently conductive as to permit marking on both sides of the paper from a single HEA on one side of the ballot. If more insulative paper is used, the voter may be instructed to insert the ballot in one of the two acceptable orientations.

Other Applications

One skilled in the art will appreciate that aspects of the invention, while described herein with reference to a ballot marking device, may find use in other applications. In particular, the techniques for manufacturing two-sided thermal printing paper described in FIGS. 2 and 3 may be useful in applications in which the thermally printable area comprises a relatively small fraction of the entire paper area. The positioning schemes of FIG. 4 and the orientation scheme of FIGS. 6 and 7 may find use in most any thermal printing application in which a user inserts single sheets of paper for printing.

As will be understood by those familiar with the art, the invention may be embodied in other specific forms without departing from the spirit or essential characteristics thereof. Likewise, the particular naming and division of the members, features, attributes, and other aspects are not mandatory or significant, and the mechanisms that implement the invention or its features may have different names, divisions and/or formats. Accordingly, the disclosure of the invention is intended to be illustrative, but not limiting, of the scope of the invention, which is set forth in the following Claims.

The invention claimed is:

1. A method of thermally marking a substrate, comprising the steps of:

providing a printable medium configured with at least one orientation indicator, the printable medium including one or more thermochromic areas;

providing a printing apparatus with a processor and at least one sensor, wherein the printing apparatus is coupled with a user interface for accepting one or more inputs from a user, wherein the printing apparatus holds the printable medium, and wherein the printing apparatus transfers heat to the printable medium with an array of heating elements;

inserting the printable medium into the printing apparatus to position one or more individual heating elements from the array of heating elements at least partially adjacent to the one or more thermochromic areas of the printable medium;

detecting the at least one orientation indicator with the at least one sensor such that the orientation of the printable medium within the printing apparatus is determined based on the position of the at least one orientation indicator;

mapping the location of the thermochromic areas by the processor using the orientation determination;

activating one or more individual heating elements from the array of heating elements that line up with the thermochromic areas of the printable medium, forming activated heating elements, wherein the activation comprises configuring the one or more individual heating elements to provide heat to the printable medium; and actuating one or more active heating elements in response to a user input to heat one or more thermochromic areas and cause the thermochromic areas to change in appearance.

2. The method of thermally marking a substrate according to claim 1, wherein the printable medium comprises a thermochromic paper.

3. The method of thermally marking a substrate according to claim 1, wherein the printable medium comprises a thermochromic voting ballot.

4. The method of thermally marking a substrate according to claim 1, wherein the printable medium comprises a two-sided thermochromic paper.

5. The method of thermally marking a substrate according to claim 4, wherein the step of providing a printable medium comprises:

providing a two-sided thermochromic medium having at least one thermochromic area on each side of the medium and a corresponding non-thermochromic area on the opposite side of medium, wherein the thermochromic areas are arranged such that actuating a first active heating element does not substantially change the appearance of a thermochromic area on the opposite side of the substrate.

6. A method of thermally marking a printable medium, comprising the steps of:

providing a two-sided thermochromic medium having at least one thermochromic area on each side of the medium and a corresponding non-thermochromic area on the opposite side of the medium; and arranging the layout of the thermochromic areas such that heating a thermochromic region does not substantially change the appearance of the opposite side of the printable medium;

providing at least one orientation indicator on the medium;

providing a printing apparatus with a processor and at least one sensor, wherein the printing apparatus is coupled with a user interface for accepting one or more inputs from a user, wherein the printing apparatus holds the printable medium, and wherein the printing apparatus transfers heat to the printable medium with an array of heating elements;

inserting the printable medium into the printing apparatus to position one or more individual heating elements from the array of heating elements at least partially adjacent to the one or more thermochromic areas of the printable medium;

detecting the at least one orientation indicator with the at least one sensor such that the orientation of the printable medium within the printing apparatus is determined based on the position of the at least one orientation indicator;

mapping the location of the thermochromic areas by the processor using the orientation determination;

activating one or more individual heating elements from the array of heating elements that line up with the thermochromic areas of the printable medium, forming activated heating elements, wherein the activation comprises configuring the one or more individual heating elements to provide heat to the printable medium; and actuating one or more active heating elements in response to a user input to heat one or more thermochromic areas and cause the thermochromic areas to change in appearance.

7. The method of thermally marking a substrate according to claim 6, wherein the substrate comprises thermochromic paper.

8. The method of thermally marking a substrate according to claim 6, wherein the substrate comprises a thermochromic voting ballot.

9. The method of thermally marking a substrate according to claim 6, wherein the substrate comprises two-sided thermochromic paper.

* * * * *